US011536092B2

(12) United States Patent
Kim et al.

(10) Patent No.: US 11,536,092 B2
(45) Date of Patent: Dec. 27, 2022

(54) BREECH LOCK CONNECTION FOR DRILLING RISER AUXILIARY LINE

(71) Applicant: Cameron International Corporation, Houston, TX (US)

(72) Inventors: Ryan Kim, Katy, TX (US); Harold Tenorio, Houston, TX (US); Michael Unterkircher, Houston, TX (US); Jorge Pau, Houston, TX (US); Ernesto Guevara, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 110 days.

(21) Appl. No.: 16/939,940

(22) Filed: Jul. 27, 2020

(65) Prior Publication Data

US 2022/0025716 A1 Jan. 27, 2022

(51) Int. Cl.
*E21B 17/08* (2006.01)
*E21B 17/01* (2006.01)

(52) U.S. Cl.
CPC ..... *E21B 17/01* (2013.01); *E21B 17/0853* (2020.05)

(58) Field of Classification Search
CPC ..... E21B 17/01; E21B 17/085; E21B 17/0853
See application file for complete search history.

(56) References Cited

U.S. PATENT DOCUMENTS

| | | | | |
|---|---|---|---|---|
| 8,505,980 | B2 * | 8/2013 | Vatne | E21B 17/01 285/27 |
| 10,012,044 | B2 * | 7/2018 | Leba | E21B 17/085 |
| 10,655,403 | B2 * | 5/2020 | Fraczek | E21B 17/01 |
| 2004/0256096 | A1 * | 12/2004 | Adams | E21B 17/085 166/85.1 |
| 2009/0200747 | A1 | 8/2009 | Williams | |
| 2010/0300699 | A1 | 12/2010 | Papon et al. | |
| 2011/0209878 | A1 * | 9/2011 | Guesnon | E21B 17/01 166/367 |
| 2015/0096759 | A1 * | 4/2015 | Gilmore | E21B 43/01 166/345 |
| 2018/0320466 | A1 | 11/2018 | Fraczek et al. | |

OTHER PUBLICATIONS

International Search Report and Written Opinion issued in International Patent application PCT/2021/043162 dated Nov. 16, 2021, 11 pages.

* cited by examiner

*Primary Examiner* — Matthew R Buck
(74) *Attorney, Agent, or Firm* — Kelly McKinney

(57) ABSTRACT

An auxiliary line system for a drilling riser includes a first auxiliary line portion configured to couple to a first section of the drilling riser, a second auxiliary line portion configured to couple to a second section of the drilling riser, and a breech lock connection. The breech lock connection includes a first portion configured to couple to the first auxiliary line portion and comprising a first engagement feature and a second portion configured to couple to the second auxiliary line portion and comprising a second engagement feature. The breech lock connection is configured to adjust between a locked configuration and an unlocked configuration.

18 Claims, 7 Drawing Sheets

BREECH LOCK CONNECTION FOR DRILLING RISER AUXILIARY LINE

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources have a profound effect on modern economies and societies. In order to meet the demand for such natural resources, numerous companies invest significant amounts of time and money in searching for, accessing, and extracting oil, natural gas, and other natural resources. Particularly, once a desired natural resource is discovered below the surface of the earth, drilling systems are often employed to access the desired natural resource. These drilling systems can be located onshore or offshore depending on the location of the desired natural resource. Such drilling systems may include a drilling fluid system configured to circulate drilling fluid into and out of a wellbore to facilitate drilling the wellbore.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
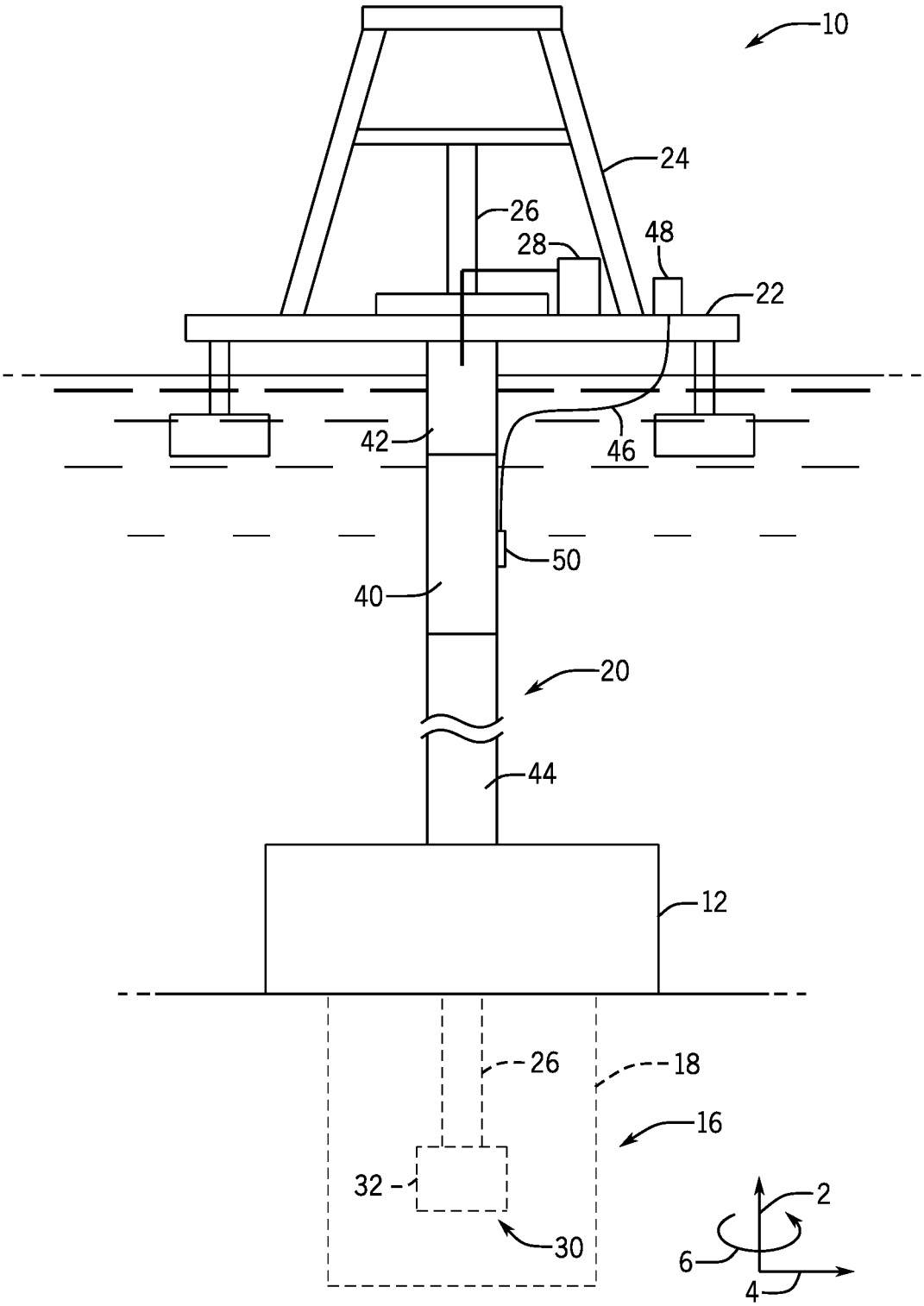
FIG. 1 is a schematic diagram of a drilling system, in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," "said," and the like, are intended to mean that there are one or more of the elements. The terms "comprising," "including," "having," and the like are intended to be inclusive and mean that there may be additional elements other than the listed elements. The use of "top," "bottom," "above," "below," and variations of these terms is made for convenience, but does not require any particular orientation of the components relative to some fixed reference, such as the direction of gravity. The term "fluid" encompasses liquids, gases, vapors, and combinations thereof. Numerical terms, such as "first," "second," and "third" may be used to distinguish components to facilitate discussion, and it should be noted that the numerical terms may be used differently or assigned to different elements in the claims. The drawing figures are not necessarily to scale. Certain features and components herein may be shown exaggerated in scale and/or in somewhat schematic form. Some details may not be shown in the interest of clarity and conciseness.

As set forth above, a drilling system may include a drilling fluid system that is configured to circulate drilling fluid into and out of a wellbore to facilitate drilling the wellbore. For example, the drilling fluid system may provide a flow of the drilling fluid through a drill string as the drill string rotates a drill bit that is positioned at a distal end portion of the drill string. The drilling fluid may exit through one or more openings at the distal end portion of the drill string and may return toward a platform of the drilling system via an annular space between the drill string and a casing that lines the wellbore.

In some cases, the drilling system may use managed pressure drilling ("MPD"). MPD regulates a pressure and a flow of the drilling fluid within the drill string so that the flow of the drilling fluid does not over pressurize a well (e.g., expand the well) and/or blocks the well from collapsing under its own weight. The ability to manage the pressure and the flow of the drilling fluid enables use of the drilling system to drill in various locations, such as locations with relatively softer sea beds.

The drilling system of the present disclosure may include an integrated riser joint (IRJ), which may include a rotating control device (RCD), an annular blowout preventer (BOP), and/or other components (e.g., flow spool). The IRJ may include a housing (e.g., multi-section housing) that defines a bore, and the drill string may extend through the bore during drilling operations. The RCD may include an RCD seal element that is configured to seal against and to rotate with the drill string to thereby block a fluid flow (e.g., the drilling fluid, cuttings, and/or natural resources [e.g., carbon dioxide, hydrogen sulfide]) from passing across the RCD seal element of the RCD from the well toward the platform. Similarly, the annular BOP may include an annular BOP seal element that is configured to seal against the drill string and/or against itself (e.g., across the bore) to thereby block the fluid flow from passing across the annular BOP seal element of the annular BOP from the well toward the platform. While the RCD seal element and/or the annular BOP seal element is in a closed configuration, the fluid flow may be diverted toward another suitable location (e.g., a collection tank) other than the platform.

As discussed in more detail below, the IRJ may include one or more auxiliary lines that are positioned external to the housing of the IRJ and that extend along a length of the IRJ. Advantageously, for each auxiliary line, a breech lock connection may be used to couple sections of the auxiliary line to one another. The breech lock connection may facilitate maintenance operations (e.g., inspection, repair, replacement operations) for the IRJ. For example, the IRJ may be hoisted to a surface and supported on a spider, the breech lock connection may be adjusted from a locked configuration in which the breech lock connection couples the sections of the auxiliary line to one another to an unlocked configuration in which the breech lock connection does not couple the sections of the auxiliary line to one another. Then, while the breech lock connection is in the unlocked configuration and the sections of the auxiliary line are not coupled to one another, sections of the housing of the IRJ may also be separated from one another to enable an operator to access the RCD seal element, the annular BOP seal element, and/or other components within the IRJ.

With the foregoing in mind, FIG. 1 is a schematic diagram of an embodiment of a drilling system 10 that is configured to carry out drilling operations. The drilling system 10 may be a subsea system, although the disclosed embodiments may be adapted for use in a land-based (e.g., surface) system. The drilling system 10 may use MPD techniques. As illustrated, the drilling system 10 includes a wellhead assembly 12 coupled to a mineral deposit via a well 16 having a wellbore 18.

The wellhead assembly 12 may include or be coupled to multiple components that control and regulate activities and conditions associated with the well 16. For example, the wellhead assembly 12 generally includes or is coupled to pipes, bodies, valves, and seals that enable drilling of the well 16, route produced minerals from the mineral deposit, provide for regulating pressure in the well 16, and provide for the injection of drilling fluids into the wellbore 18. A conductor may provide structure for the wellbore 18 and may block collapse of the sides of the well 16 into the wellbore 18. A casing may be disposed within the conductor. The casing may provide structure for the wellbore 18 and may facilitate control of fluid and pressure during drilling of the well 16.

A drilling riser 20 may extend between the wellhead assembly 12 and a platform 22. The platform 22 may include or support various components that facilitate operation of the drilling system 10, such as pumps, tanks, and power systems. The platform 22 may also include a derrick 24 that supports a tubular 26 (e.g., drill string), which may extend through the drilling riser 20. A drilling fluid system 28 may direct the drilling fluid into the tubular 26, and the drilling fluid may exit through one or more openings at a distal end portion 30 of the tubular 26 and may return (along with cuttings and/or other substances from the well 16) toward the platform 22 via an annular space (e.g., between the tubular 26 and the casing that lines the wellbore 18; between the tubular 26 and the drilling riser 20). A drill bit 32 may be positioned at the distal end portion 30 of the tubular 26. The tubular 26 may rotate within the drilling riser 20 to rotate the drill bit 32, thereby enabling the drill bit 32 to drill and form the well 16.

As shown, the drilling system 10 may include an integrated riser joint (IRJ) 40 that forms part of the drilling riser 20. The drilling system 10 may also include other features, such as a telescopic riser joint (TRJ) 42 that is configured to enable heave of the platform 22 and standard riser joints 44 (e.g., bare riser joints; hollow pipes). The TRJ 42 and the standard riser joints 44 may also form part of the drilling riser 20. As shown, the IRJ 40 is positioned between the TRJ 42 and the standard riser joints 44.

The IRJ 40 may include a rotating control device (RCD), an annular blowout preventer (BOP), and/or other components (e.g., flow spool). The IRJ 40 may also include one or more auxiliary lines 46, which may deliver fluid (e.g., high-pressure fluid from a fluid source 48) to components of the wellhead assembly 12 and/or which may support power and/or control lines for components of the wellhead assembly 12, for example. As discussed in more detail below, a breech lock connection 50 (e.g., breech lock connection system) may be provided for each auxiliary line 46. Together, the breech lock connection 50 and the auxiliary line 46 may form an auxiliary line system. The breech lock connection 50 may facilitate maintenance operations for the IRJ 40. The drilling system 10 and its components may be described with reference to the vertical axis 2 (or vertical direction), a radial axis 4 (or longitudinal direction), and a circumferential axis 6 (or direction) to facilitate discussion.

Figure 2:
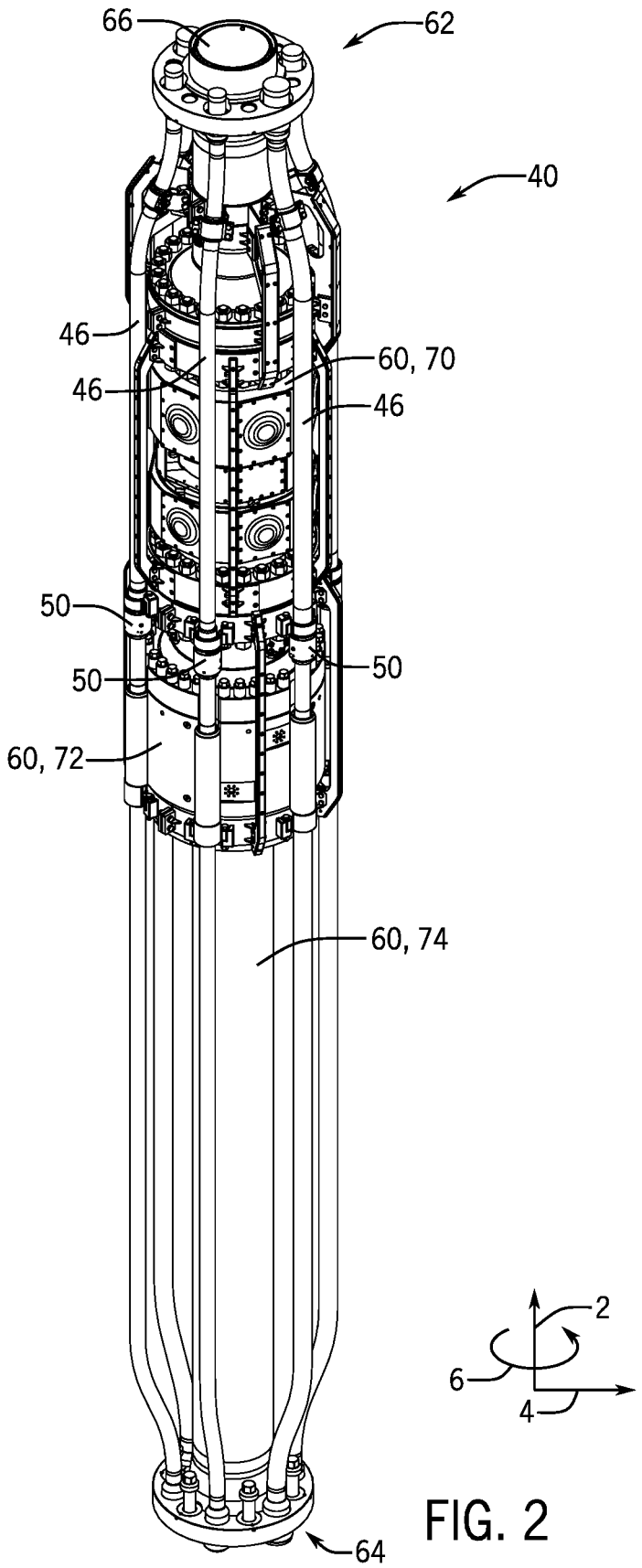
FIG. 2 is a perspective view of an integrated riser joint (IRJ) that may be used in the drilling system of FIG. 1, in accordance with an embodiment of the present disclosure.

FIG. 2 is a perspective view of the IRJ 40 that may be used in the drilling system of FIG. 1. As shown, the IRJ 40 includes a housing 60 (e.g., multi-section housing) that extends from a first end 62 to a second end 64. The first end 62 may be configured to couple to a first portion of the drilling riser, such as to the TRJ, and the second end 64 may be configured to couple to a second portion of the drilling riser, such as to one of the standard riser joints. In this way, a bore 66 of the IRJ 40 may align with (e.g., along the vertical axis 2) and/or be fluidly coupled to bores in other portions of the drilling riser to thereby form a continuous bore that extends through an entirety of the drilling riser.

The housing 60 may have multiple sections that are coupled to one another via one or more fasteners (e.g., threaded fasteners, such as bolts). In the illustrated embodiment, the housing 60 includes a first section 70 (e.g., RCD section) that houses an RCD, a second section 72 (e.g., annular BOP section) that houses an annular BOP, and a third section 74 (e.g., flow spool section) that may house another component, such as a flow spool that facilitates the return of the drilling fluid (along with cuttings and/or natural resources) to the platform.

The IRJ 40 also includes the one or more auxiliary lines 46, which may deliver the fluid to components of the wellhead assembly and/or which may support power and/or control lines for components of the wellhead assembly, for example. As shown, multiple auxiliary lines 46 may be spaced apart and distributed circumferentially about the housing 60, and each auxiliary line 46 may extend from the first end 62 to the second end 64 of the IRJ 40. A respective breech lock connection 50 is provided for each auxiliary line 46.

Figure 3:
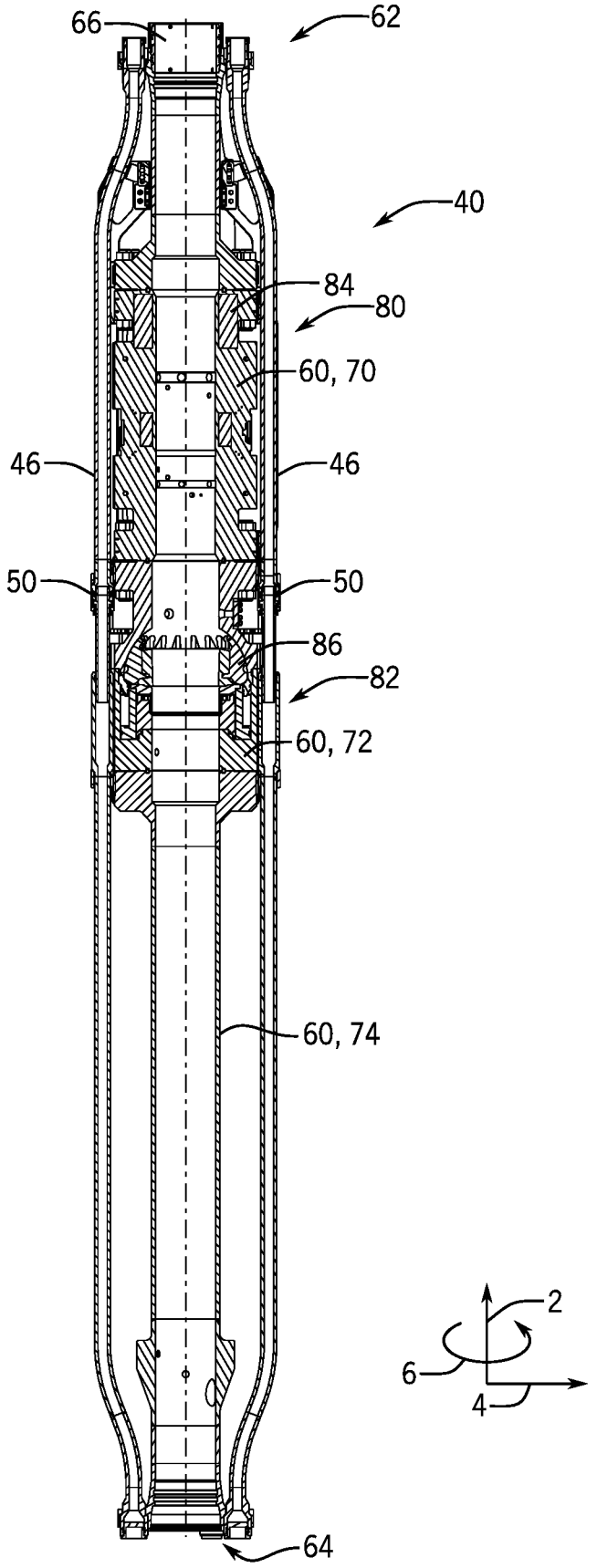
FIG. 3 is a cross-sectional side view of the IRJ of FIG. 2, in accordance with an embodiment of the present disclosure.

FIG. 3 is a cross-sectional side view of the IRJ 40 of FIG. 2. As shown, the IRJ 40 includes the housing 60 that extends from the first end 62 to the second end 64. The housing 60 defines the bore 66 and includes multiple sections 70, 72, 74 that are coupled to one another via the one or more fasteners. In particular, the first section 70 houses an RCD 80, the second section 72 houses an annular BOP 82, and the third section 74 may house another component, such as a flow spool.

The RCD 80 may include an RCD seal element 84 (e.g., one or more annular seal elements) that is configured to seal against and to rotate with the drill string to thereby block a fluid flow from passing across the RCD seal element 84 of the RCD 80 from the well toward the platform. Similarly, the annular BOP 82 may include an annular BOP seal element 86 that is configured to seal against the drill string and/or against itself (e.g., across the bore 66) to thereby block the fluid flow from passing across the annular BOP seal element 86 of the annular BOP 82 from the well toward the platform. While the RCD seal element 84 and/or the annular BOP seal element 86 is in a closed configuration (e.g., to seal the bore 66), the fluid flow may be diverted toward another suitable location (e.g., a collection tank) other than the platform.

As shown, the IRJ 40 also includes the one or more auxiliary lines 46. The auxiliary lines 46 are positioned external to (e.g., radially-outwardly of) the housing 60, and each auxiliary line 46 extends from the first end 62 to the second end 64 of the IRJ 40. Furthermore, a respective breech lock connection 50 is provided for each auxiliary line 46. Additional structural and operational features of the breech lock connection 50 may be understood with reference to FIGS. 4-8.

Figure 4:
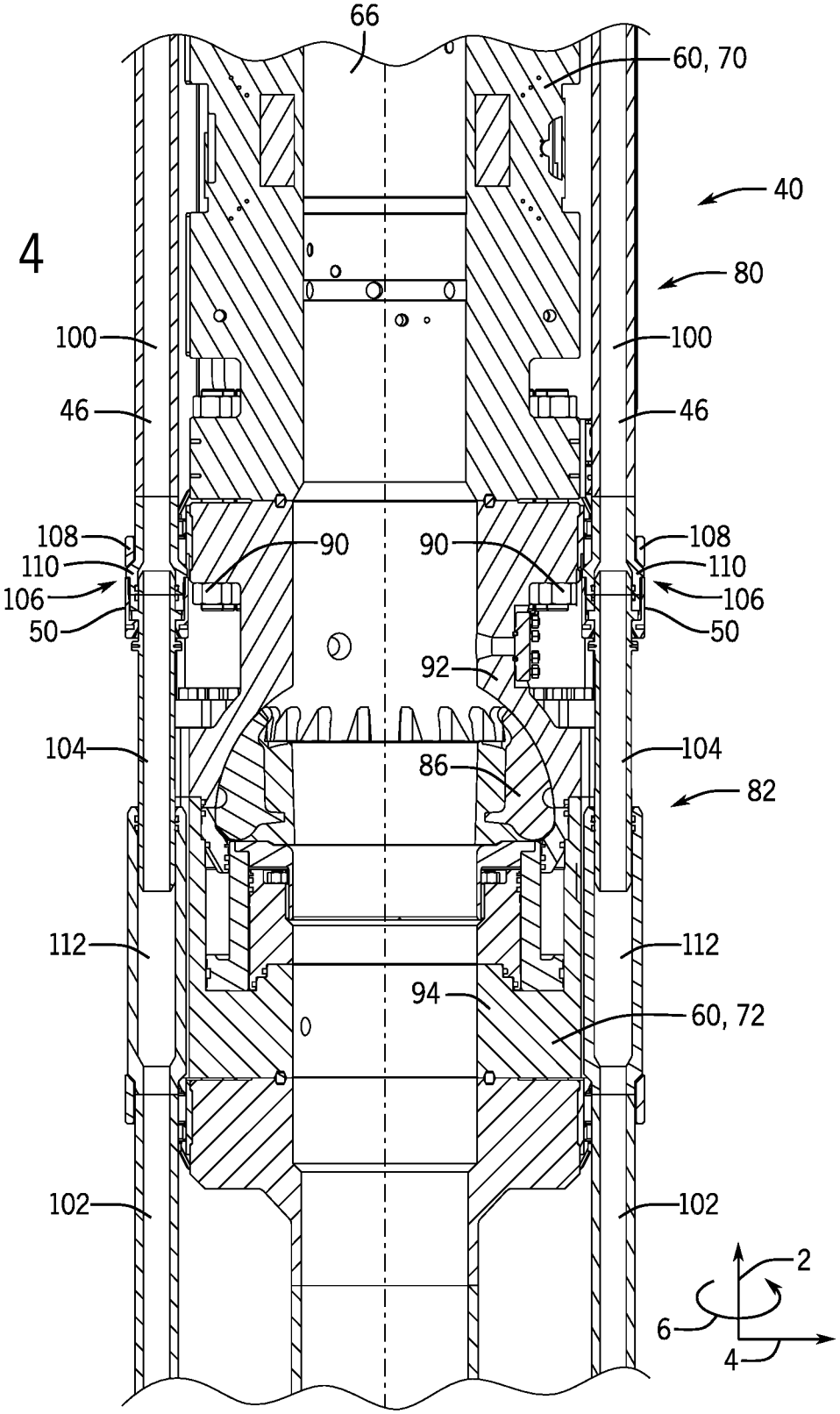
FIG. 4 is a cross-sectional side view of a portion of the IRJ of FIG. 2, in accordance with an embodiment of the present disclosure.

FIG. 4 is a cross-sectional side view of a portion of the IRJ 40 of FIG. 3. As shown, the IRJ 40 includes the housing 60 that defines the bore 66 and includes multiple sections 70, 72 that are coupled to one another via the one or more fasteners 90. In the illustrated embodiment, the first section 70 houses the RCD 80 and the second section 72 houses the annular BOP 82. Furthermore, the second section 72 includes a first annular BOP portion 92 and a second annular BOP portion 94 that together support and surround the annular BOP seal element 86. The first annular BOP portion 92 and the second annular BOP portion 94 may also be coupled via respective fasteners 90. However, various other configurations of the first section 70 and/or the second section 72 are envisioned.

The one or more auxiliary lines 46 are positioned external to the housing 60. Each auxiliary line 46 also includes a first auxiliary line portion 100 and a second auxiliary line portion 102 that are configured to be coupled to one another via the respective breech lock connection 50. As shown, each breech lock connection 50 includes a rod portion 104 (e.g., male connector; floating male stab; second portion) and a receptacle portion 106 (e.g., female connector; first portion; annular portion). In some embodiments, the receptacle portion 106 may include multiple components, such as a box 108 (e.g., annular box) and a hub 110 (e.g., annular hub; locking hub). However, other configurations of the receptacle portion 106 are envisioned. For example, the box 108 and the hub 110 may be integrally formed as one piece. Alternatively, the box 108 may be integrally formed with the first auxiliary line portion 100.

As discussed in more detail below, the rod portion 104 may include a respective engagement feature (e.g., second engagement feature), such as radially-outwardly extending rod protrusions (e.g., one or more protrusions) that are spaced apart from one another circumferentially about the rod portion 104. Furthermore, the receptacle portion 106 may include a respective engagement features (e.g., first engagement features), such as radially-inwardly extending receptacle protrusions (e.g., one or more protrusions) that are spaced apart from one another circumferentially about the receptacle portion 106. In such cases, the rod protrusions and the receptacle protrusions may be spaced to enable the rod portion 104 to be received within the receptacle portion 106 (e.g., such that the receptacle portion 106 circumferentially surrounds the rod portion 104), and then upon rotation of at least one of the components (e.g., upon rotation of at least part of the receptacle portion 106), the rod protrusions and the receptacle protrusions may engage one another (e.g., overlap) to retain the rod portion 104 within the receptacle portion 106 (e.g., to block movement of the rod portion 104 along the vertical axis 2, such as movement of the rod portion 104 downward along the vertical axis 2 toward the wellbore when installed as part of the drilling riser for the well). As shown, the second auxiliary line portion 102 includes a recess 112 that is configured to receive and to circumferentially surround at least some of the rod portion 104.

In the illustrated embodiment of FIG. 4, each of the breech lock connections 50 is in a locked configuration (e.g., engaged configuration) in which the rod protrusions and the receptacle protrusions engage one another to retain the rod portion 104 within the receptacle portion 106. In the locked configuration, the breech lock connection 50 couples the first auxiliary line portion 100 to the second auxiliary line portion 102 to form a continuous auxiliary line 46 (e.g., continuous from the first end to the second end of the IRJ 40) that is configured to support a fluid flow or cables (e.g., power cables), for example.

Each of the breech lock connections 50 may be adjustable from the locked configuration to an unlocked configuration (e.g., disengaged configuration) in which the rod protrusions and the receptacle protrusions do not engage one another. In particular, to move to the unlocked configuration, at least one of the portions of the breech lock connection 50, such as at least part of the receptacle portion 106, may be rotated to cause the rod protrusions and the receptacle protrusions to disengage from one another. This rotation enables the rod portion 104 to then move along the vertical axis 2 (e.g., downward along the vertical axis 2) along the second auxiliary line portion 102 and/or into the recess 112. The rod portion 104 may move in this way due to gravitational force and/or due to another force applied (e.g., by the operator). In the unlocked configuration, the breech lock connection 50 does not couple the first auxiliary line portion 100 to the second auxiliary line portion 102, and thus, the first auxiliary line portion 100 and the second auxiliary line portion 102 are physically separated from one another (e.g., disconnected; interrupted) and do not form the continuous auxiliary line 46.

It may be desirable to adjust the breech lock connection 50 to the unlocked configuration to cause separation of the first auxiliary line portion 100 and the second auxiliary line portion 102 during certain maintenance operations. For example, in order to complete certain maintenance operations (e.g., inspect, repair, or replace the annular BOP seal element 86) a hoisting device may lift the IRJ 40 onto a spider on the platform. Then, an operator (or device) may rotate at least one of the components of the breech lock connection 50 in the manner disclosed herein to cause the rod protrusions and the receptacle protrusions to disengage from one another. As a result, the rod portion 104 may slide or move along the vertical axis 2 into the recess 112. The one or more fasteners 90 may then be adjusted to enable the first section 70 and the second section 72 of the housing 60 to be separated from one another. For example, the first section 70 of the housing 60 may be lifted off of the second section 72 of the housing 60, while the second section 72 of the housing 60 remains supported on the spider. In some embodiments, the second section 72 of the housing 60 may remain supported on the spider in a generally upright position (e.g., a central axis of the second section 72 of the housing 60 is aligned with the vertical axis 2; the second section 72 is not laid down on its side).

In this way, the operator may complete maintenance operations on the first section 70 of the housing 60 (and the components supported within or coupled thereto, such as the RCD seal element) and the second section 72 of the housing 60 (and the components supported within or coupled thereto, such as the annular BOP seal element 86) without separating the auxiliary lines 46 from the housing 60. In particular, the first auxiliary line portion 100 may remain coupled to the first section 70 of the housing 60 (e.g., to a respective flange of the first section 70 of the housing 60), and the second auxiliary line portion 102 may remain coupled to the second section 72 of the housing 60 (e.g., to a respective flange of the second section 72 of the housing 60) during the maintenance operations. Furthermore, the receptacle portion 106 of the breech lock connection 50 may remain coupled to the first section 70 of the housing 60 (e.g., via the first auxiliary line portion 100), and/or the rod portion 104 of the breech lock connection 50 may remain coupled to the second section 72 of the housing 60 (e.g., via the second auxiliary line portion 102; supported within the recess 112) during the maintenance operations. Advantageously, the operator does not separately lift or withdraw an entire length of the auxiliary line 46 (e.g., that extends from the first end to the second end of the IRJ 40) or separate the auxiliary line 46 from the housing 60 in order to access components of the IRJ 40, such as the annular BOP seal element 86. Thus, the maintenance operations may be carried out efficiently, which results in cost savings, for example.

Figure 5:
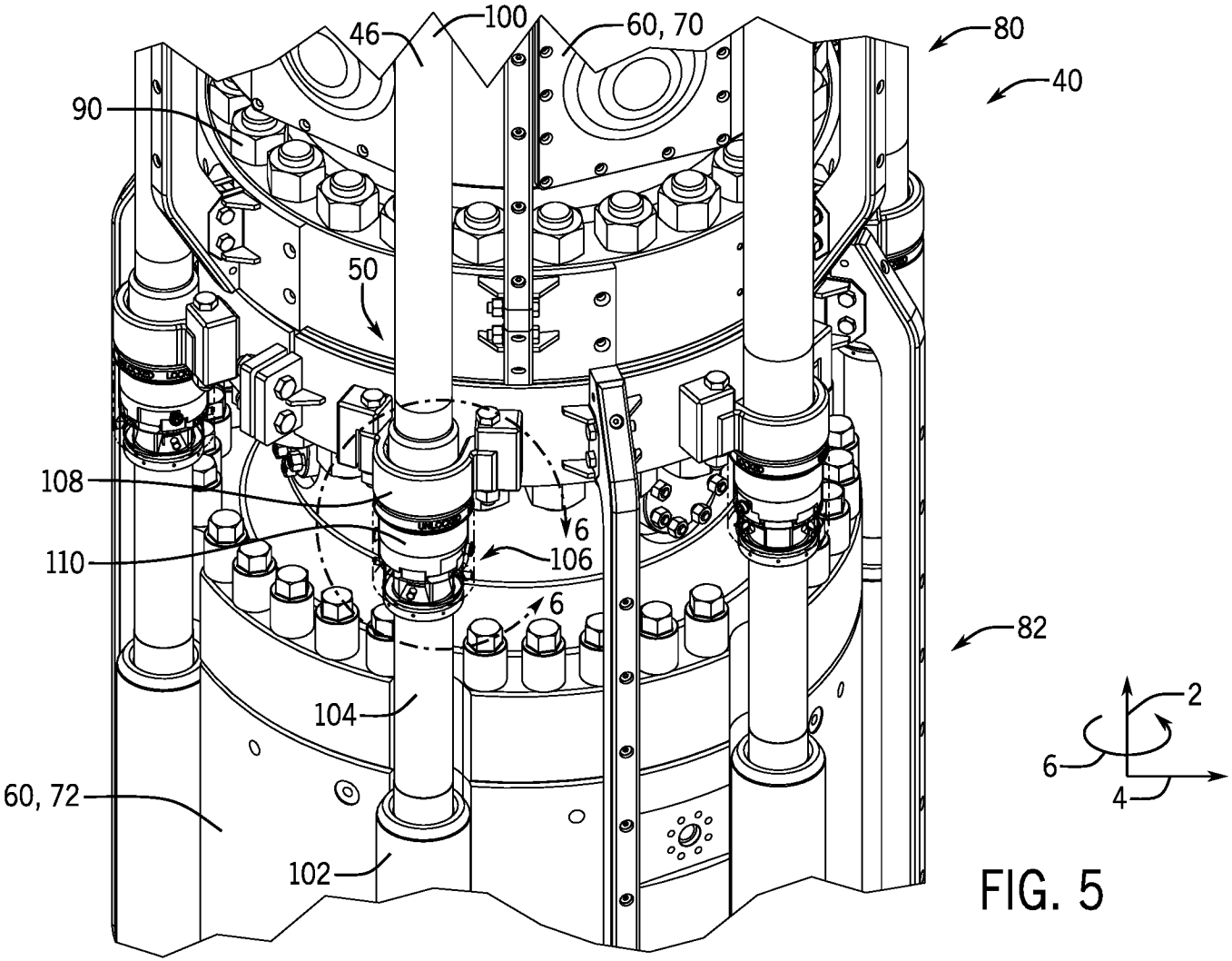
FIG. 5 is perspective view of a portion of the IRJ of FIG. 2, in accordance with an embodiment of the present disclosure.
Figure 6:
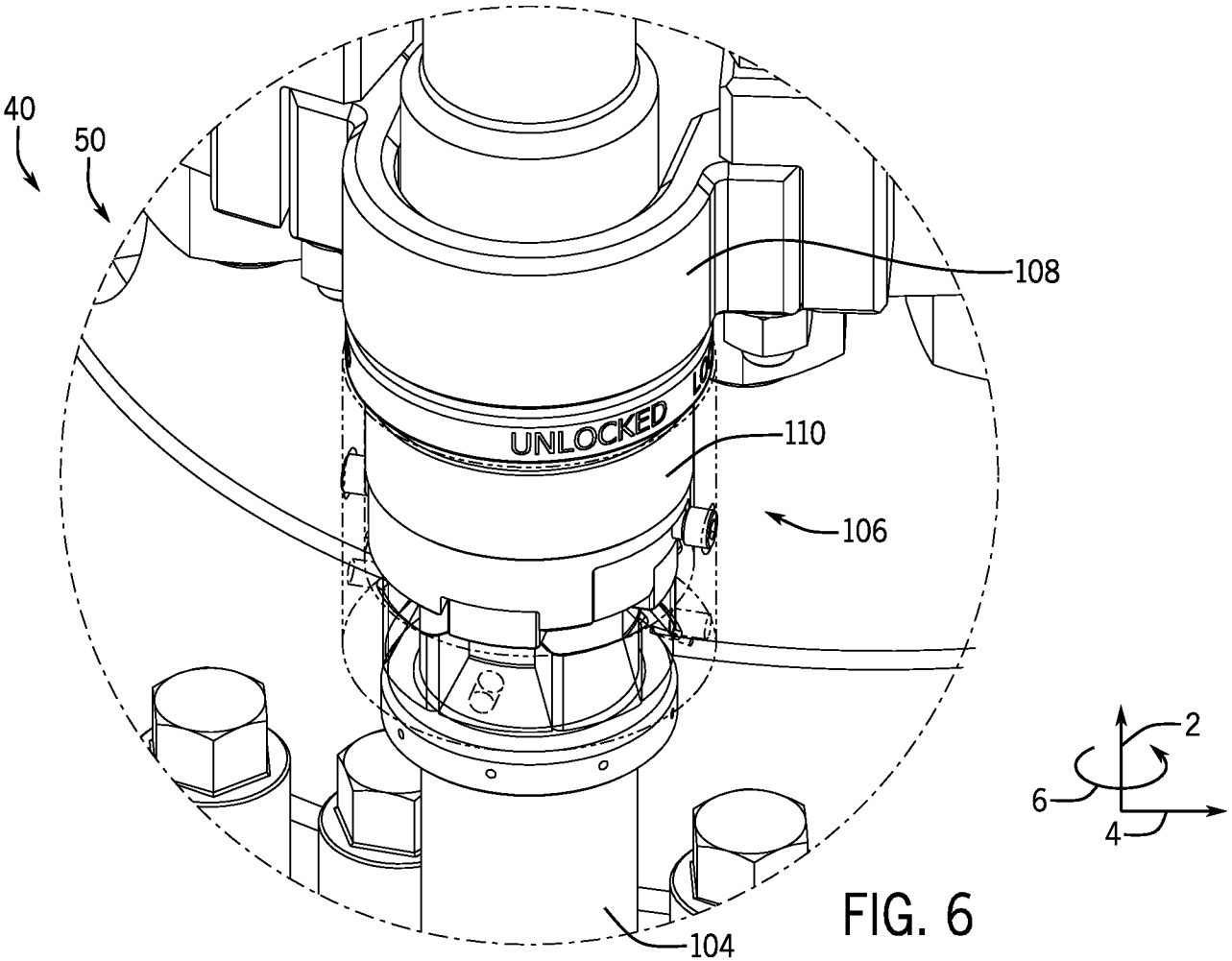
FIG. 6 is a perspective view of a portion of the IRJ taken within line 6-6 of FIG. 5, wherein the portion includes a breech lock connection, in accordance with an embodiment of the present disclosure.

FIG. 5 is perspective view of a portion of the IRJ 40. As shown, the IRJ 40 includes the housing 60 that defines the bore and includes multiple sections 70, 72 that are coupled to one another via the one or more fasteners 90. In the illustrated embodiment, the first section 70 houses the RCD 80 and the second section 72 houses the annular BOP 82. The one or more auxiliary lines 46 are positioned external to the housing 60. Each auxiliary line 46 also includes the first auxiliary line portion 100 and the second auxiliary line portion 102 that are configured to be coupled to one another via the respective breech lock connection 50. As shown, each breech lock connection 50 includes the rod portion 104 and the receptacle portion 106. In some embodiments, the receptacle portion 106 may include the box 108 and the hub 110. Additional features of the breech lock connection 50 are shown in FIG. 6, which is a perspective view of a portion of the IRJ 40 taken within line 6-6 of FIG. 5.

Figure 7:
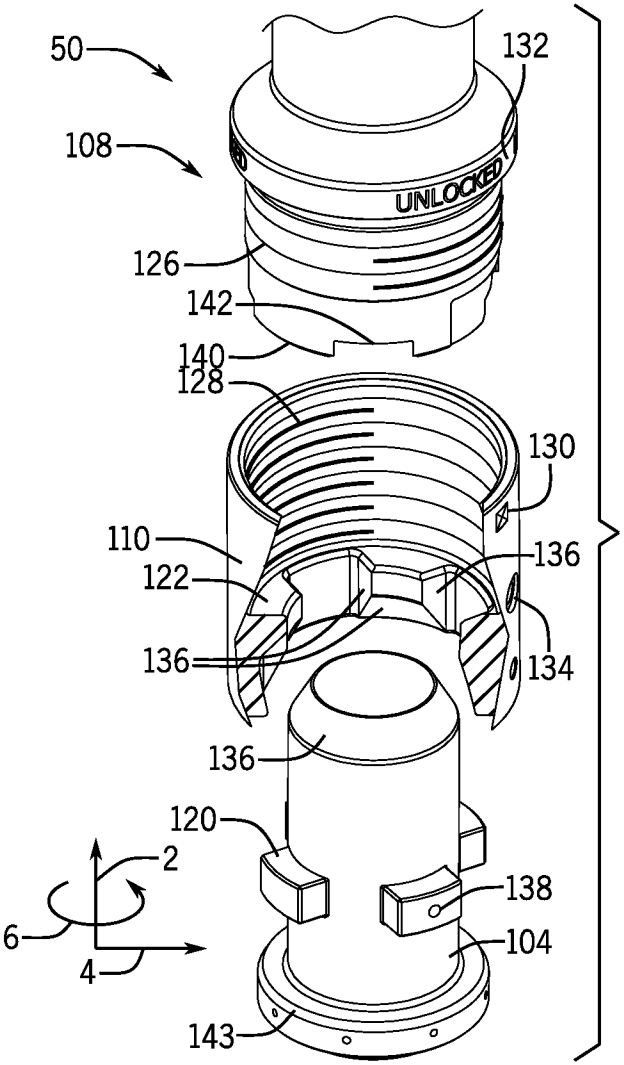
FIG. 7 is an exploded view of the breech lock connection of FIG. 6, in accordance with an embodiment of the present disclosure.

FIG. 7 is an exploded view of a portion of the breech lock connection 50. As shown, the breech lock connection 50 includes the rod portion 104 and the receptacle portion 106. In some embodiments, the receptacle portion 106 may include the box 108 and the hub 110. As shown, the rod portion 104 includes rod protrusions 120 (e.g., radially-outwardly extending; second protrusions) that are spaced apart from one another circumferentially about the rod portion 104 (e.g., about a respective side wall of the rod portion 104). Furthermore, the receptacle portion 106 includes receptacle protrusions 122 (e.g., radially-inwardly extending; first protrusions) that are spaced apart from one another circumferentially about the receptacle portion 106 (e.g., about a respective side wall of the receptacle portion 106). The rod protrusions 120 and the receptacle protrusions 122 are spaced apart to enable the rod portion 104 to be received within the receptacle portion 106 (e.g., while the rod portion 104 and the receptacle portion 106 are in a first configuration relative to one another; while the rod protrusions 120 are misaligned with the receptacle protrusions 122). For example, the rod protrusions 120 may fit between the receptacle protrusions 122 as the rod portion 104 moves into the receptacle portion 106 along the vertical axis 2. Once the rod protrusions 120 pass through the receptacle protrusions 122, at least one of the components (e.g., at least the hub 110) may be rotated such that the rod protrusions 120 and the receptacle protrusions 122 overlap (e.g., are stacked along the vertical axis 2) and engage one another to retain the rod portion 104 within the receptacle portion 106 (e.g., to block movement of the rod portion 104 along the vertical axis 2, such as movement of the rod portion 104 downward along the vertical axis 2 toward the wellbore when installed as part of the drilling riser for the well).

Where the receptacle portion 106 includes the box 108 and the hub 110, the box 108 and the hub 110 may be coupled to one another via a threaded interface. For example, the box 108 may include box threads 126 on a radially-outer surface of the box 108, and the hub 110 may include hub threads 128 on a radially-inner surface of the hub 110. The box threads 126 and the hub threads 128 may be configured to threadably couple to one another. With this configuration, the box 108 may be coupled (e.g., non-rotatably coupled) to the first auxiliary line portion. Thus, the box 108 and the first auxiliary line portion may generally remain in place relative to the housing of the IRJ, and the hub 110 may rotate (e.g., via the operator) relative to the box 108 via the threaded interface. The rod portion 104 may be supported on the second auxiliary line portion (e.g., slidingly supported within the recess of the second auxiliary line portion).

The breech lock connection 50 may include various features to facilitate adjustment between the unlocked configuration and the locked configuration. For example, as shown the hub 110 may include a hub indicator 130 (e.g., visual indicator, such as a symbol) and the box 108 may include a box indicator 132 (e.g., visual indicator, such as text). When the hub 110 indicator 130 and the box indicator 132 are aligned (e.g., the symbol is aligned with the text that says "unlocked"), this may indicate to the operator that the breech lock connection 50 is in the unlocked configuration.

In some embodiments, the hub 110 may include a tool recess 134 that is configured to receive and be engaged by a tool (e.g., held by the operator). In some embodiments, the tool may be used to facilitate rotation of the hub 110 and/or to lock the hub 110 to the rod portion 104 to maintain the locked configuration. For example, in the locked configuration, the tool recess 134 may a recess 138 in the rod portion 104. Then, upon insertion of the tool (e.g., locking rod or threaded fastener) into the tool recess 134 and the recess 138 in the rod portion 104, the tool may block relative movement between the hub 110 and the rod portion 104. It should be appreciated that the tool recess 134 and the recess 138 may be provided at any suitable location. Furthermore, the breech lock connection 50 may include separate recesses for engagement with the tool to rotate the hub 110 and for engagement with the tool to lock the hub 110. As shown, the rod portion 104 and/or the hub 110 (e.g., the receptacle protrusions 122) may include various tapered surfaces 136 to facilitate centering and/or sliding the rod portion 104 within the hub 110.

In some embodiments, one or more stops (e.g., protrusions) and/or corresponding indents (e.g., grooves) may be provided to block (e.g., limit) the rotation of the hub 110 and/or to provide a tactile indication of whether the breech lock configuration 50 is in the locked configuration or the unlocked configuration. As shown the rod portion 104 may include a lip 143 (e.g., radially-extending lip) that is configured to engage with a side wall (e.g., annular wall) of the second auxiliary line portion to block travel of the rod portion 104 into the recess (e.g., such that at least a portion of the rod portion 104 remains exposed in the unlocked configuration). While the disclosure provides examples of rotating the hub 110, it should be appreciated that both the hub 110, the rod portion 104, or both may rotate to adjust the breech lock connection 50 between the locked configuration and the unlocked configuration.

Figure 8:
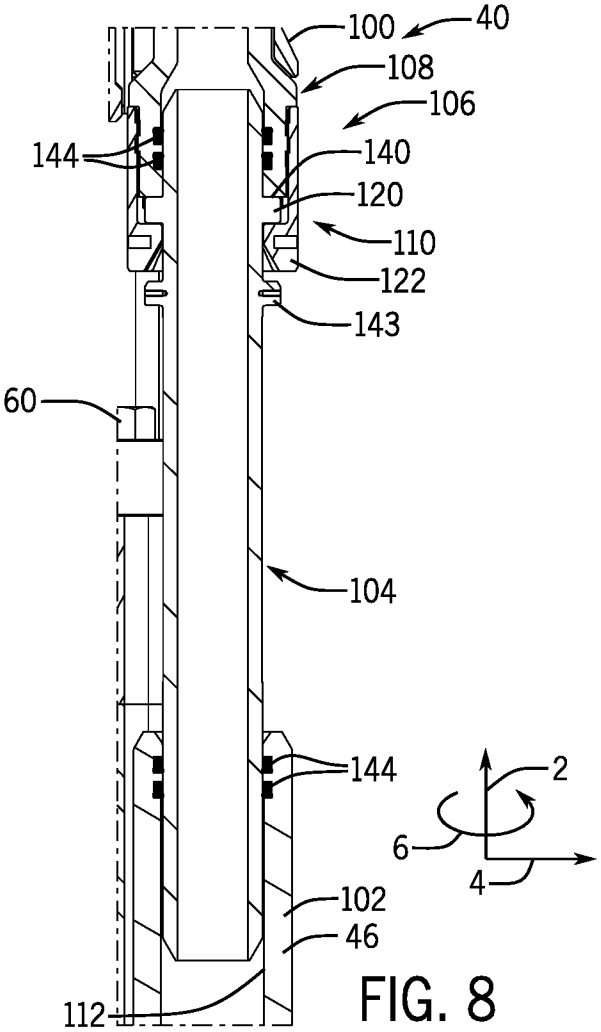
FIG. 8 is a cross-sectional side view of the breech lock connection of FIG. 6, in accordance with an embodiment of the present disclosure.

FIG. 8 is a cross-sectional side view of components of the breech lock connection 50 within the IRJ 40. As shown, the IRJ 40 includes the housing 60, and the one or more auxiliary lines 46 are positioned external to the housing 60. Each auxiliary line 46 includes the first auxiliary line portion 100 and the second auxiliary line portion 102 that are configured to be coupled to one another via the respective breech lock connection 50. As shown, each breech lock connection 50 includes the rod portion 104 and the receptacle portion 106, which may include the box 108 and the hub 110. In the locked configuration, the rod protrusions 120 and the receptacle protrusions 122 engage one another (e.g., are stacked along the vertical axis 2). In some embodiments, in the locked configuration, the rod protrusions 120 may be positioned between and/or may contact (e.g., trapped between) both the receptacle protrusions 122 and a surface 140 of the box 108. Furthermore, the surface 140 may include circumferentially-spaced recesses 142 (e.g., grooves) that may receive the rod protrusions 120 and/or hold the rod protrusions 120 in the locked configuration (e.g., block movement along the vertical axis 2 and/or the circumferential axis 6). As shown, the rod portion 104 may include the lip 143 as well. Additionally, to seal the auxiliary line 46 (e.g., to provide a fluid-tight passage or conduit), one or more seal elements 144 (e.g., annular seal elements) may be provided. For example, one or more seal elements 144 may be provided to seal between the rod portion 104 and the receptacle portion 106, and one or more seal elements 144 may be provided to seal between the rod portion 104 and the second auxiliary line portion 102. The breech lock connection 50 is positioned (e.g., along the vertical axis 2) so as to expose or make accessible the fasteners that couple the sections of the housing 60 to one another while the breech lock connection 50 is in the unlocked configuration (e.g., the rod portion 104 slides into the recess 112 to expose the fasteners).

It should be appreciated that all of the features discussed above with respect to FIGS. 1-8 may be combined in any suitable manner. Additionally, various modifications are envisioned. For example, while the rod portion 104 is shown as being received within the receptacle portion 106, it should be appreciated that the rod portion 104 may be hollow and the receptacle portion 106 may be received within the rod portion 104 (e.g., the rod protrusions 120 may extend radially-inwardly and the receptacle protrusions may extend radially-outwardly). As another example, the rod portion 104 may be coupled to the first auxiliary line portion 100, while the receptacle portion 106 may be coupled to the second auxiliary line portion 102 (e.g., the rod portion 104 is positioned vertically above the receptacle portion 106). As another example, the second auxiliary line portion 102 may be received within a recess of the rod portion 104 (e.g., the rod portion 104 may circumferentially surround the second auxiliary line portion 102). The breech lock connection may also be adapted for use with auxiliary lines in other portions of the drilling riser, in other configurations of the drilling riser (e.g., without the IRJ), or in any other portion of the drilling system.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is intended to cover all modifications, equivalents, and alternatives falling within the spirit and scope of the disclosure as defined by the following appended claims.

The invention claimed is:

1. An auxiliary line system for a drilling riser, the auxiliary line system comprising:

a first auxiliary line portion configured to couple to a first section of the drilling riser;

a second auxiliary line portion configured to couple to a second section of the drilling riser; and a breech lock connection, comprising:

a first portion configured to couple to the first auxiliary line portion and comprising a first engagement feature, wherein the first engagement feature comprises first radially-extending protrusions; and a second portion configured to couple to the second auxiliary line portion and comprising a second engagement feature, wherein the second engagement feature comprises second radially-extending protrusions, wherein the breech lock connection is configured to adjust between a locked configuration in which the first engagement feature and the second engagement feature engage one another to block relative movement between the first portion and the second portion and an unlocked configuration in which the first engagement feature and the second engagement feature are disengaged from one another to enable relative movement between the first portion and the second portion, wherein, in the unlocked configuration of the breech lock connection, the first auxiliary line portion and the first portion of the breech lock connection are configured to remain coupled to the first section of the drilling riser, and the second auxiliary line portion and the second portion of the breech lock connection are configured to remain coupled to the second section of the drilling riser.

2. The auxiliary line system of claim 1, wherein the first auxiliary line portion, the second auxiliary line portion, and the breech lock connection are configured to form a continuous auxiliary line while the breech lock connection is in the locked configuration.

3. The auxiliary line system of claim 1, wherein the second portion comprises a rod portion, and the first portion comprises a receptacle portion that is configured to receive the rod portion.

4. The auxiliary line system of claim 1, wherein the first radially-extending protrusions are spaced apart circumferentially about the first portion, and the second radially-extending protrusions are spaced apart circumferentially about the second portion.

5. The auxiliary line system of claim 4, wherein the first radially-extending protrusions and the second radially-extending protrusions are spaced apart to enable each of the second radially-extending protrusions to pass between adjacent first radially-extending protrusions.

6. The auxiliary line system of claim 1, wherein the first portion comprises an annular hub that comprises the first engagement feature, and the annular hub is configured to rotate relative to the second portion to adjust the breech lock connection between the locked configuration and the unlocked configuration.

7. The auxiliary line system of claim 6, wherein the first portion comprises an annular box that is non-rotatably coupled to the first auxiliary line portion and that is threadably coupled to the annular hub.

8. The auxiliary line system of claim 1, comprising a first recess in the first portion and a second recess in the second portion, wherein the first recess and the second recess are configured to align with one another while the breech lock connection is in the locked configuration to enable insertion of a locking tool into the first recess and the second recess.

9. A drilling riser joint for a drilling system, the drilling riser joint comprising:

a housing comprising a first section and a second section that are configured to couple to one another via one or more threaded fasteners;

a first auxiliary line portion configured to couple to the first section of the housing;

a second auxiliary line portion configured to couple to the second section of the housing; and a breech lock connection, comprising:

a receptacle portion configured to couple to the first auxiliary line portion and comprising radially-extending receptacle protrusions; and a rod portion configured to couple to the second auxiliary line portion and comprising radially-extending rod protrusions that are configured to engage the radially-extending receptacle protrusions in a locked configuration in which the rod portion is blocked from moving vertically relative to the receptacle portion, wherein in an unlocked configuration of the breech lock connection, the radially-extending rod protrusions and the radially-extending receptacle protrusions are disengaged from one another, the first auxiliary line portion and the receptacle portion of the breech lock connection remain coupled to the first section of the housing, and the second auxiliary line portion and the rod portion of the breech lock connection remain coupled to the second section of the housing.

10. The drilling riser joint of claim 9, comprising a rotating control device positioned within the housing.

11. The drilling riser joint of claim 10, comprising an annular blowout preventer positioned within the second section of the housing, wherein the rotating control device is positioned within the first section of the housing.

12. The drilling riser joint of claim 9, wherein the second auxiliary line portion comprises a recess, and the rod portion is configured to slide within the recess to thereby slidingly couple to the second auxiliary line portion.

13. The drilling riser joint of claim 9, wherein the radially-extending receptacle protrusions are spaced apart circumferentially about the receptacle portion, and the radially-extending rod protrusions are spaced apart circumferentially about the rod portion.

14. The drilling riser joint of claim 9, wherein the first auxiliary line portion, the second auxiliary line portion, and the breech lock connection are configured to form a continuous auxiliary line that extends from a first end of the drilling riser joint to a second end of the drilling riser joint while the breech lock connection is in the locked configuration.

15. The drilling riser joint of claim 14, wherein the first auxiliary line portion, the second auxiliary line portion, and the breech lock connection are configured not to form the continuous auxiliary line while the breech lock connection is in the unlocked configuration.

16. A method of performing a maintenance operation for a drilling riser joint, the method comprising:

supporting the drilling riser joint on a platform;

adjusting a breech lock connection of an auxiliary line system from a locked configuration to an unlocked configuration to thereby separate a first auxiliary line portion coupled to a first section of a housing of the drilling riser joint from a second auxiliary line portion coupled to a second section of the housing of the drilling riser joint from one another;

adjusting one or more threaded fasteners to thereby separate the first section of the housing and the second section of the housing from one another to access components within the housing;

separating of the first section of the housing and the second section of the housing from one another without decoupling the first auxiliary line portion from the first section of the housing and without decoupling the second auxiliary line portion from the second section of the housing, when the breech lock connection is in the unlocked configuration.

17. The method of claim 16, wherein adjusting the breech lock connection of the auxiliary line system comprises rotating at least a portion of a receptacle portion of the breech lock connection relative to a rod portion of the breech lock connection to thereby disengage the receptacle portion from the rod portion.

18. The method of claim 17, wherein adjusting the breech lock connection of the auxiliary line system comprises disengaging receptacle protrusions from rod protrusions via rotating at least the portion of the receptacle portion of the breech lock connection.

* * * * *